United States Patent [19]

Boliver

[11] 3,960,433

[45] June 1, 1976

[54] SHIELDED POWER CABLE SEPARABLE CONNECTOR MODULE HAVING CONDUCTING CONTACT ROD WITH A BEVELED SHOULDER OVERLAPPED BY INSULATING FOLLOWER MATERIAL

[75] Inventor: Vincent J. Boliver, Pittsfield, Mass.

[73] Assignee: General Electric Company

[22] Filed: Sept. 5, 1975

[21] Appl. No.: 610,624

[52] U.S. Cl. ..... 339/111

[51] Int. Cl.[2] ..... H01R 13/52

[58] Field of Search ..... 339/111, 94 A

[56] References Cited

UNITED STATES PATENTS 3,617,987 11/1971 Sankey ..... 339/111

3,917,374 11/1975 Murdock ..... 339/111

*Primary Examiner*—Roy Lake
*Assistant Examiner*—DeWalden W. Jones
*Attorney, Agent, or Firm*—Volker R. Ulbrich

[57] ABSTRACT

A separable connector module for connecting shielded electrical power cable. It is of the type including an insulating housing containing a cable insert member. A male contact rod assembly, including a metal contact rod, is fixed at one end to the insert member. An insulating arc follower is fixed to the rod at its other end. The improvement comprises that the arc follower overlaps a beveled portion of the shoulder of the contact rod to favorably affect the configuration of the potential field there.

1 Claim, 2 Drawing Figures

SHIELDED POWER CABLE SEPARABLE CONNECTOR MODULE HAVING CONDUCTING CONTACT ROD WITH A BEVELED SHOULDER OVERLAPPED BY INSULATING FOLLOWER MATERIAL

BACKGROUND OF THE INVENTION

The present invention relates generally to electrical cable connectors and relates particularly, but not exclusively, to separable connector modules for connecting together the operating components of an underground power distribution system by means of shielded electrical cable.

Separable connector assemblies for underground power distribution cable, or shielded cable, are watertight when assembled and may be readily separated into two or more units to break a cable connection. As such units are available separately commercially for various reasons and are individually subject to special design considerations, the are commonly referred to as "modules". Thus, a connection includes two or more matching modules assembled together.

One type of separable connector commonly used is known as a "rod and bore" type. A bore connector module having a receiving bore in a shielded, insulating housing and a grasping contact member in the bore receives a matching rod connector module having rod contact which is inserted in the bore and grasped by the bore contact member.

It is desirable to be able to operate such connectors while their cables are electrically active to interrupt the power. As the cables are generally carrying power at a voltage on the order of thousands of volts, separation of the contacts of the connector on a live cable results in the formation of an electric arc between the contacts. The arc will, unless promptly extinguished, eventually strike a ground plane such as the grounded shielding of the modules, and create a direct line-to-ground fault.

In present connectors, the bore is lined with ablative material and the rod is provided with an ablative arc follower of ablative material, a material which generates arc-extinguishing gases when subjected to an electric arc. The arc follower of the rod is a rod-shaped extension at the end of the metal contact rod and is generally somewhat smaller in diameter than the rod. When the contact rod is pulled from the contact member of the bore module, the resulting arcing passes between the follower and the bore lining. The exposure of the ablative material to arcing causes it to generate arc-extinguishing gases which rapidly extinguish the arc. This permits the connector to be utilized as a switch by being operated under live conditions, without creating a line-to-ground fault.

One problem with the present design of contact rod assemblies has been premature arcing between the contact rod and the receiving contacts when the modules are connected under relatively high voltage conditions, such as at about 20 kilovolts operating voltage. The premature arcing can result in extensive damage to the connector.

SUMMARY OF THE INVENTION

The novel connector module comprises a contact rod having a beveled shoulder where the rod abuts the follower, and having the follower material overlap the beveled portion of the shoulder.

The beveled shoulder and the overlap of the follower material reduces the voltage stress near the shoulder of the contact rod and improves the voltage breakdown of the rod assembly.

DESCRIPTION OF THE PREFERRED EMBODIMENT

Figure 1:
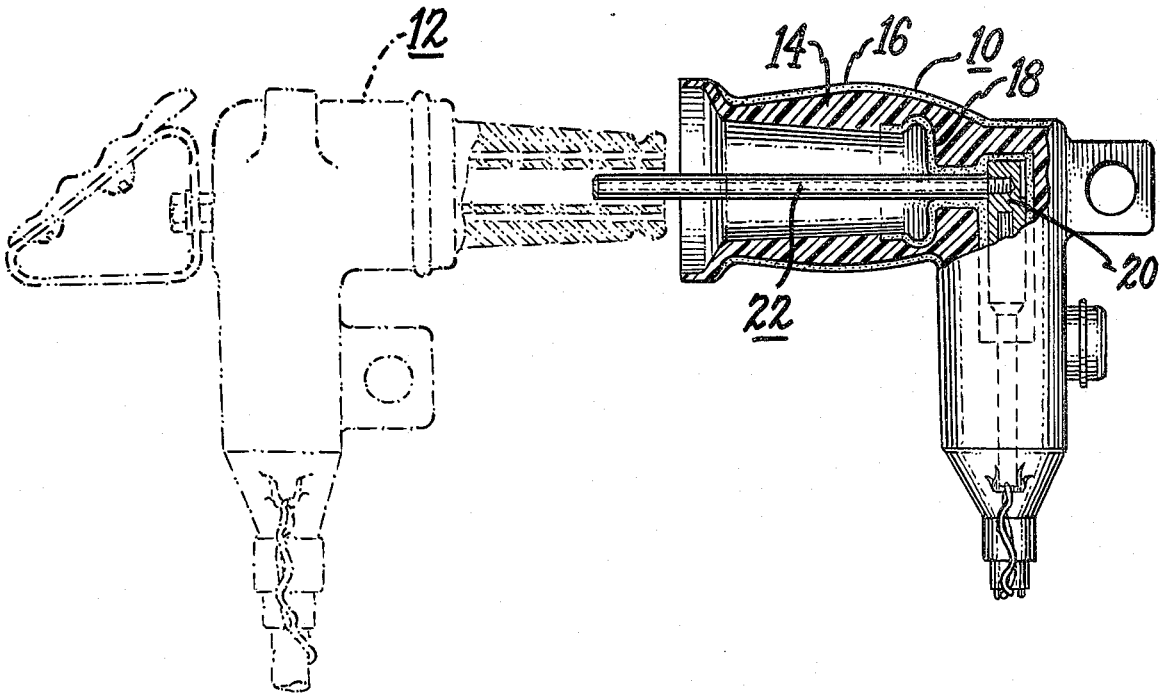
FIG. 1 is a partially sectioned side view of a matching pair of separable connector elbow modules, of which the bore connector module is shown in phantom lines and the rod connector elbow module is shown in solid lines and in accordance with the preferred embodiment of the present invention.

A preferred embodiment of the present invention is the rod connector elbow module 10 shown in FIG. 1 of the drawing. The elbow 10 is shown together with a matching bore connector module 12 drawn in phantom lines to illustrate the manner in which the two modules 10, 12 are assembled together to complete a cable connector.

The rod elbow 10 includes an insulating housing 14 of elastomer having an outer covering of resilient conductive shielding 16 and an inner recess which is lined with conductive resilient voltage grading material 18. Closely fit inside the recess is a threaded cable insert member 20, which provides a support for, and to which is secured a contact rod assembly 22, shown separately and in more detail in FIG. 2.

Figure 2:
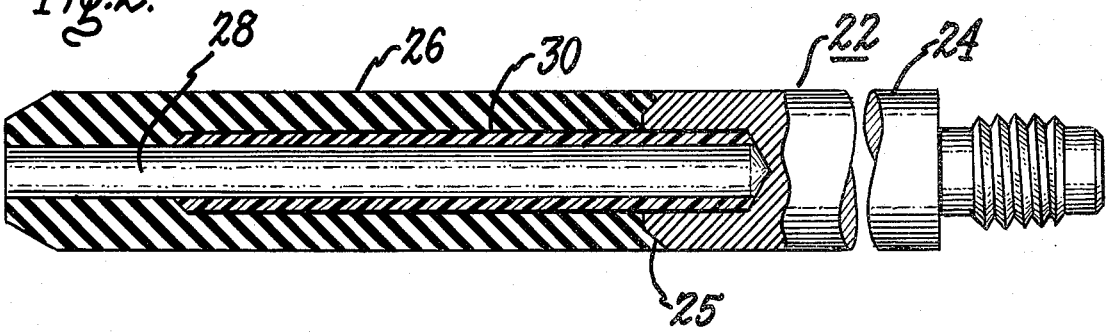
FIG. 2 is a partially sectioned side view of the contact rod assembly of the rod elbow of FIG. 1.

Referring now to FIG. 2, the rod assembly 22 consists of a round copper contact rod 24 about 11 cm long and 1.2 cm in diameter provided at one end with threads for attachment to the cable insert member 20 and provided at its other end with a beveled shoulder portion 25. Attached to the beveled end of the contact rod 24 is a hollow, rod-shaped arc follower 26 about 5 cm long and substantially the same diameter as is the rod 24. The follower 26 is of ablative material, such as, for example, a cycloaliphatic epoxy resin which may be filled with hydrated alumina. The follower material overlaps the beveled portion 25 of the contact rod 24. Extending the entire length of the follower 26 inside its hollow portion is a mounting pin 28, about 6.2 cm long and 0.6 cm in diameter, of aligned glass fibers bonded together with epoxy resin.

The bevel portion 25 of the contact rod 24 relieves the voltage stress at the shoulder portion 25 by making the drop of the shoulder more gradual. In addition, the overlap of the follower material on the beveled portion 25 improves the voltage breakdown of the follower 26 by adding to its effective length.

It should be understood that the gradual drop of the shoulder portion 25 of the contact rod 24 could also be provided by a stepwise chamfered portion rather than a bevel, with largely the same benefits, provided that the steps are not too great. In such case, however, the chamfered portion should likewise be overlapped by the follower material.

I claim:

1. Apparatus for connecting electrical power cable, the apparatus being of the type having a rod contact to be received by a bore contact, the rod contact having an insulating arc follower fixed to the end for insertion into the bore, wherein the improvement comprises:

a beveled shoulder on said contact rod adjacent said follower and overlapped by the material of said follower.

* * * * *